United States Patent [19]

Lienhard

[11] 4,398,310

[45] Aug. 16, 1983

[54] WASHSTAND DEVICE

[75] Inventor: Rolf Lienhard, Hinwil, Switzerland

[73] Assignee: Maschinenfabrik Ad. Schulthess & Co. A.G., Zurich, Switzerland

[21] Appl. No.: 220,059

[22] PCT Filed: Feb. 27, 1980

[86] PCT No.: PCT/CH80/00029

§ 371 Date: Nov. 26, 1980

§ 102(e) Date: Nov. 26, 1980

[87] PCT Pub. No.: WO80/01983

PCT Pub. Date: Oct. 2, 1980

[30] Foreign Application Priority Data

Mar. 26, 1979 [CH] Switzerland ..... 2800/79

[51] Int. Cl.[3] ..... E03C 1/05

[52] U.S. Cl. ..... 4/623; 4/628

[58] Field of Search ..... 4/661, 628, 623, 653, 4/518

[56] References Cited

U.S. PATENT DOCUMENTS

| | | | |
|---|---|---|---|
| 2,673,352 | 3/1954 | Knowles | 4/653 |
| 2,759,195 | 8/1956 | McAdon | 4/518 |
| 3,298,037 | 1/1967 | Luther | 4/653 X |
| 3,491,381 | 1/1970 | Catheart | 4/623 |
| 3,576,277 | 4/1971 | Blackmon | 4/623 |
| 3,639,920 | 2/1972 | Griffen et al. | 4/623 |
| 3,732,580 | 5/1973 | Fava | 4/518 |
| 4,074,369 | 2/1978 | Harmon | 4/518 |
| 4,144,596 | 3/1979 | MacFarlane et al. | 4/628 X |
| 4,145,769 | 3/1979 | MacFarlane et al. | 4/628 X |
| 4,295,233 | 10/1981 | Hinkel et al. | 4/628 X |

*Primary Examiner*—Henry K. Artis

*Attorney, Agent, or Firm*—Lewis H. Eslinger

[57] ABSTRACT

A sanitary handwashing apparatus includes a housing having walls defining a chamber and having a front opening through which the hands of a user can be inserted into the chamber; a washbasin located in the housing and including a drain at the bottom for removing used water; a hot-air dryer located in an upper wall of the housing above the washbasin for supplying hot-air into the chamber; a water supply nozzle located in the upper wall of the housing above the washbasin for supplying water into the chamber; a soap dispenser located in the housing above the washbasin for supplying soap into the chamber; and a discharge opening in the back wall of the housing which defines the chamber for discharging hot-air supplied to the chamber by the hot-air dryer and for supplying the discharged air to the hot-air dryer.

5 Claims, 2 Drawing Figures

WASHSTAND DEVICE

Known washstands have, among other things, a basin with water faucets and drainage, and a device for drying the hands. Much has been said in the past about the hygiene of such washstands.

It has also been explained, for example, that the water faucet should not be operated manually, since touching it with the unwashed hand, as is generally done, may have the effect of transmitting germs from user to user.

Many discussions of known devices for drying the hands have been published. The hygiene of the many different types of hand towel has also been argued. After a sufficiently long wait, the automatic hand towel always supplies a clean section of the cloth roll. Also known are devices for providing paper or cloth napkins for drying the hands. Aside from careless handling of the napkins, pulling them away incorrectly and/or wasting them, bits of them scatter through the air in the room, thus spreading the germs with which they are covered.

The hot-air hand dryer was then developed as an alternative, in which the air drawn from the room or the fresh air drawn into it is blown downward after flowing through an air heater in one stream or in two intersecting streams. But here again hygienic considerations are somewhat neglected since the germs may eddy around the room by means of the relatively strong air stream from the hot-air hand dryer.

It can therefore be considered that no washstand that can be used to wash and dry the hands under completely hygienic conditions is now available.

The purpose of the invention is to improve the precarious relationships described above with a washstand design having a basin, water supply, and drainage, with a hot-air hand dryer, in accordance with the introductory paragraphs of the independent patent claim.

This purpose is accomplished by the features of the independent patent claim of the invention.

A prototype of the invention is described below with the aid of the drawing, in which.

Figure 2:
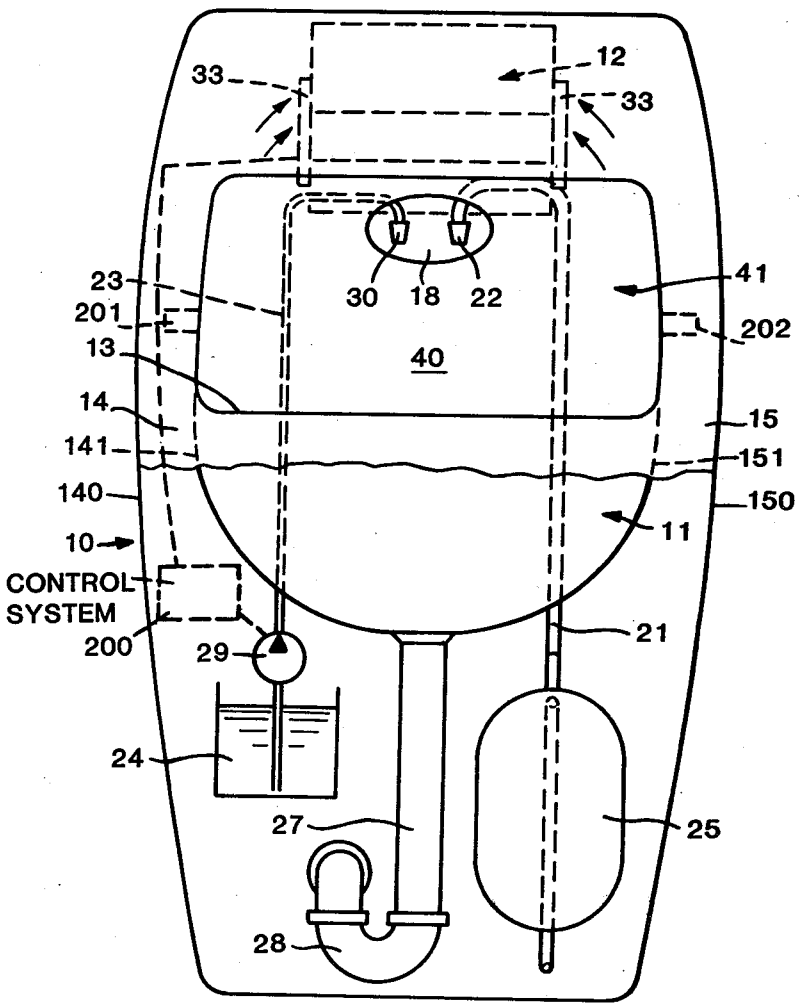
FIG. 2 shows a front view of the washstand of FIG. 1 with a cutaway view of the lower section.

No special indications of the wall thicknesses for the housing are given in the drawing; they are merely sketched in.

The housing 10 includes a wash basin 11 with a water supply pipe 21 and a drainpipe 27 with an odor remover, as well as a hot-air hand dryer 12 with a ventilator section 20, an air heater section 19, and an air vent 18. Running near the water supply pipe 21 is a second pipe 23, carrying a fluid cleanser—liquid soap, for example—which is pumped upward from its supply source 24 by a dosage pump 29. The water supply nozzle 22, the nozzle 30 of the pipe 23, and the air vent 18 are all in the same area.

The housing 10 is built with a double wall, and consists of a front wall 13 with an outer wall 130 and an inner wall 131, two side walls 14 and 15, each with an outer wall 140 and 150 and an inner wall 141 and 151, as well as a rear wall 16 with an outer wall 160 and inner wall 161. There are also a cover 31 and an outer wall 310 and an inner wall 311, as well as a floor 32 with an outer wall 320 and an inner wall 321. The inner wall 321 of the floor 32 forms the inner contour of the wash basin 11, and the inner wall 311 of the cover 31 contains the apertures for the air vent and the water and soap supplies 21 and 23. The inner wall 161 of the rear wall 16 has an air exhaust opening 17.

All the inner walls 131, 141, 151, 161, 311, and 321, surround a wash chamber 40 with an opening 41 in the front wall 13, which permits both hands 50 to enter comfortably.

Along with the feed pipes 21 and 23 for water and soap, mentioned above, another container for the care of the head can be installed in the wash chamber 40 with another feed pipe. To keep the diagram simplified, this equipment is not shown; this additional device may take the same form as the soap-dispensing system, with its supply source 24, the dosage pump 29, feed pipe 23, and nozzle 30.

The nozzle of the water pipe could be made in the form of a shower head. Supply for the water feed is obtained from the water heater 25, which can be made as a continuous heater or reservoir. The water is fed through a shutoff valve.

Figure 1:
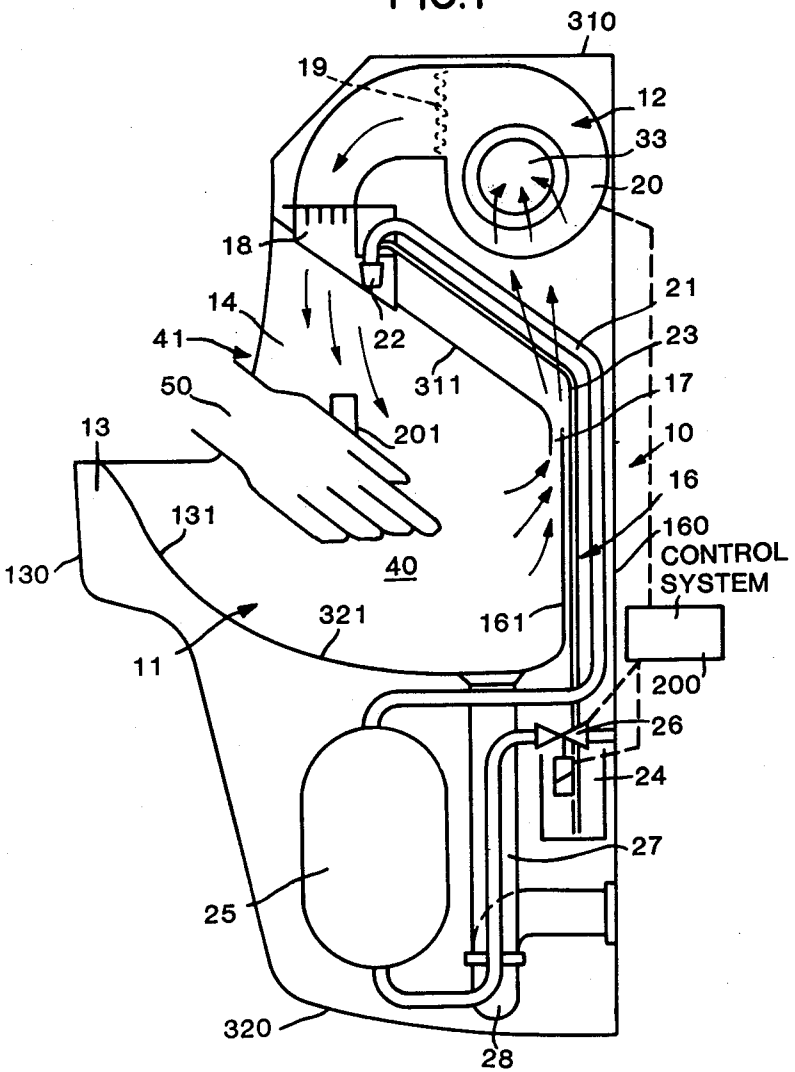
FIG. 1 shows a cutaway profile view of the washstand invention.

As indicated by the arrows in FIG. 1, the side inner walls 141 and 151 as well as the front inner wall 131 are formed such that the air stream coming into the air aperture 18 from the ventilator 20 cannot emerge through the opening 41 into the surrounding space. Consequently, a means for disinfection and/or air purification can be installed in the space between the upper inner wall 311 and the upper outer wall 310 in the airstream region between the air exhaust opening 17 and the air inlet opening 33 of the ventilator 20. This means, such as dust filters, activated carbon filters alone or in combination with an ultraviolet lamp, is known.

A control system 200 may be installed for regulating the moistening, washing, rinsing, and drying stages of the washing process with respect to time. The triggering device can be a light barrier 201, 202 between the front edges of the side walls. This light barrier should open the shutoff valve 26 to provide the first burst of water from the water heater 25 through the water supply aperture. As the next step, soap is brought from the supply source 24 by means of the dosage pump 29 into the washing chamber 40. After a pause allowed for rubbing the hands in order to clean them, a second burst of water is supplied from the water heater 25 for cleansing by rinsing away the soapy residue. Finally, the washing process ends with the drying stage, done by the hot-air dryer 12. Another means for care of the head could be supplied before, during, or shortly after the drying process.

Such a system removes all the objections with regard to cleanliness and hygiene mentioned in the introduction. The user does not have to manipulate faucets, soap dispensers, or the like. The air from the hot-air dryer is purified and disinfected before it is returned to circulation or expelled. Since the hot air wanders over practically all the walls of the washing chamber, they are also dried so that no bacterial colonies can breed in a hospitably damp environment.

The program for the run of the washing process could include still another step after the resetting of the light barrier since a means of disinfection will also be spread across the walls of the washing chamber 40. In addition, several washing programs over intervals of various durations can be provided with more or less soap supply, for satisfactory cleansing of badly soiled hands. So that nothing will actually be touched by dirty hands, a leg-operated or hand-operated switch may be used.

A further advantage of the washstand invention is that the least possible quantity of water can be pre-programmed such that for washstands with limited water supply, such as in railroad cars, aircraft, or dry land areas, complete exhaustion of the water supply can be avoided. It also has an environment protection aspect since the heat energy for warming the water is economized and a minimum of drainage water goes to water purification stations or the like, the result of the fact that the water inlet is not left uncontrolled for any length of time.

I claim:

1. Handwashing apparatus comprising:

a housing having walls defining a chamber and having a front opening through which at least one hand can be inserted into the chamber;

a washbasin located in said housing and including discharge means for removing used water;

hot-air dryer means located in said housing for supplying hot-air into said chamber;

water supply means located in said housing above said washbasin for supplying water into said chamber;

soap dispensing means located in said housing above said washbasin for supplying soap into said chamber;

a discharge opening in at least one wall of said housing which defines said chamber for discharging hot air supplied to said chamber by said hot-air dryer means and for supplying said discharged air to said hot-air dryer means; and control means for automatically controlling operation of said water supply means, said soap dispensing means and said hot-air dryer means when said at least one hand is inserted through said front opening into said chamber.

2. Handwashing apparatus according to claim 1; in which said housing includes side walls and a front wall which define said chamber and which force said hot air supplied to said chamber through said discharge opening.

3. Handwashing apparatus comprising:

a housing having walls defining a chamber and having a front opening through which at least one hand can be inserted into the chamber;

a washbasin located in said housing and including discharge means for removing used water;

hot-air dryer means located in said housing for supplying hot-air into said chamber;

water supply means located in said housing above said washbasin for supplying water into said chamber;

soap dispensing means located in said housing above said washbasin for supplying soap into said chamber;

a discharge opening in at least one wall of said housing which defines said chamber for discharging hot air supplied to said chamber by said hot-air dryer means and for supplying said discharged air to said hot-air dryer means;

said housing further including conduit means extending between said discharge opening and said hot-air dryer means for supplying said hot air discharged through said discharge opening to said hot-air dryer means for reuse; and said apparatus further includes filter means for at least one of disinfecting and cleaning said hot-air supplied by said conduit means.

4. Handwashing apparatus according to claim 1; in which said housing includes an upper wall defining the chamber and having at least one aperture therein, and said water supply means includes a water supply nozzle for supplying water through said at least one aperture into said chamber, said soap dispensing means includes a soap supply nozzle for supplying soap through said at least one aperture into said chamber, and said hot-air dryer means includes an air vent for supplying hot air through said at least one aperture into said chamber.

5. Handwashing apparatus according to claim 1; in which said control means, when said at least one hand is inserted through said front opening into said chamber, automatically controls said water supply means to first supply water into said chamber for wetting said at least one hand, said soap dispensing means to next supply soap into said chamber for washing said at least one hand, said water supply means to next supply water into said chamber for rinsing said at least one hand, and said hot-air drying means to next supply hot air into said chamber for drying said at least one hand.

* * * * *